United States Patent [19]

Shoemaker

[11] 4,303,185

[45] Dec. 1, 1981

[54] FRONT OPENING HOLSTER

[76] Inventor: Loren R. Shoemaker, 664 Chaparro Rd., Covina, Calif. 91724

[21] Appl. No.: 939,256

[22] Filed: Sep. 5, 1978

[51] Int. Cl.[3] ..... F41B 13/04

[52] U.S. Cl. ..... 224/193; 224/911

[58] Field of Search ..... 224/2 B, 2 C, 2 D, 2 E, 224/2 F, 2 G, 26 R, 26 B, 5 R, 5 A, 5 B, 5 H, 5 E, 911

[56] References Cited

U.S. PATENT DOCUMENTS

| | | | |
|---|---|---|---|
| 2,765,968 | 10/1956 | Gaylord | 224/2 B |
| 3,777,952 | 12/1973 | Theodore | 224/911 X |
| 3,865,289 | 2/1975 | Boren | 224/911 X |
| 4,079,870 | 3/1978 | Clark | 224/2 B |
| 4,084,734 | 4/1978 | Bianchi et al. | 224/2 B |
| 4,101,060 | 7/1978 | Bianchi et al. | 224/2 B |

*Primary Examiner*—Robert J. Spar
*Assistant Examiner*—Kenneth Noland
*Attorney, Agent, or Firm*—Boniard I. Brown

[57] ABSTRACT

A front-opening holster for handguns such as pistols, has an inner liner and an outer facing which encase the barrel, body and trigger portions of the gun, the facing and liner portions extending along the sides of the barrel and being biased together by a spring therebetween to enclose the gun from its muzzle to its trigger. A pivot on the holster fits between the trigger guard and the handle of the gun, so that with the gun in a normal hip position, it may be drawn by grasping the exposed handle and rotating it about the pivot to open the holster front by separating the liner and the facing until the heretofore protected trigger and barrel clear the holster, whereupon the gun is ready for firing.

12 Claims, 7 Drawing Figures

FRONT OPENING HOLSTER

BACKGROUND OF THE INVENTION

Handguns, such as revolvers and pistols, which are carried in holsters, must be removable therefrom with all feasible speed in order to provide timely and effective use of the handgun together with security of the user, in emergency situation. This is particularly true when a law enforcement officer is the user of the weapon and the weapon normally is not drawn unless an emergency situation is encountered. For comfort and convenience, it is desirable that the holster be worn high on the hip, yet such a position makes normal holsters awkward to use, as it is difficult for the user to pull the weapon upwardly out of the holster. Therefore, front opening holsters have been developed which allow the user to wear his holster high on the hip with the barrel pointed downward and yet allow him to remove the weapon while in sitting or standing positions, with speed and safety. When carrying an exposed weapon near other persons, the user of such holsters also has been particularly vulnerable to losing control of the weapon to someone behind him.

There have been numerous past attempts to provide suitable holsters, and certain of these providing a forward-draw capability. U.S. Pat. No. 2,347,006 to TIBBETS and U.S. Pat. No. 3,630,420 to BIANCHI are typical examples, with TIBBETS providing a pivot between the barrel and the trigger guard, thereby enabling an unauthorized user to gain access to the trigger while the weapon is in the holster, and BIANCHI requiring trigger-first removal of the weapon, which slows down the draw, because this requires rotation first in one direction followed by reversal of rotation in the opposite direction to bring the barrel to the usual horizontal orientation or a line of fire.

SUMMARY OF THE INVENTION

The present invention provides a front opening holster separable portions of which are urged together at the front of the holster by the biasing action of an internal spring. It completely protects the pistol including its trigger and its hammer from unauthorized use, since only the handle of the pistol extends from the holster. A strap with a one-way thumb break whose operation is not apparent to the uninitiated is provided to protect the hammer while a pair of stiff rearwardly extending flap portions protect the trigger. In operation by the thumb once the user's hand has contacted the handle of the pistol. The pistol is then rotated about a pivot which is formed on the holster between the trigger guard and the handle of the pistol so that the muzzle can be rotated upwardly into firing position. Once the muzzle has rotated to an appropriate horizontal position, the trigger is unguarded by a suitable cutout in the holster allowing use of the pistol only after it has rotated to a position where it is unlikely that the user will inflict a self-injury by accidental early discharge of the weapon. The holster also includes suitable means for connection to a hip belt or other means for attaching the holster to the user's body.

Due to a combination of operative features and design, the holster is constructed easily from flat pieces of leather and can be adapted to most revolver type handguns. The holster is safe since it requires that the handgun be removed therefrom before the pistol can be fired and such removal, although easily accomplished by the wearer, is difficult by an unauthorized person both because of his lack of knowledge of how the pistol is released from the holster and the fact that it cannot be operated while it is in the holster because the trigger is guarded by the holster, and the hammer cannot be operated due to the strap thereover.

It is therefore an object of the present invention to provide a holster for handguns which can be worn high on the hip and yet the handgun can be removed safely and quickly therefrom without a reverse rotation or unneeded movement.

Another object is to provide a holster which prevents the firing of a handgun as long as it remains therein.

Another object is to provide a handgun user with a holster which is difficult to operate by an unauthorized person whether he be in front of, behind or beside the user.

Another object is to provide a holster with a break open front which is relatively easy and economical to manufacture, and yet can perform its duties on a day-in, day-out basis for an extended period of time.

These and other objects and advantages of the present invention will become apparent to those skilled in the art after considering the following detailed specification which covers a preferred embodiment thereof in conjunction with the accompanying drawings.

DETAILED DESCRIPTION OF THE PRESENT EMBODIMENT

Figure 1:
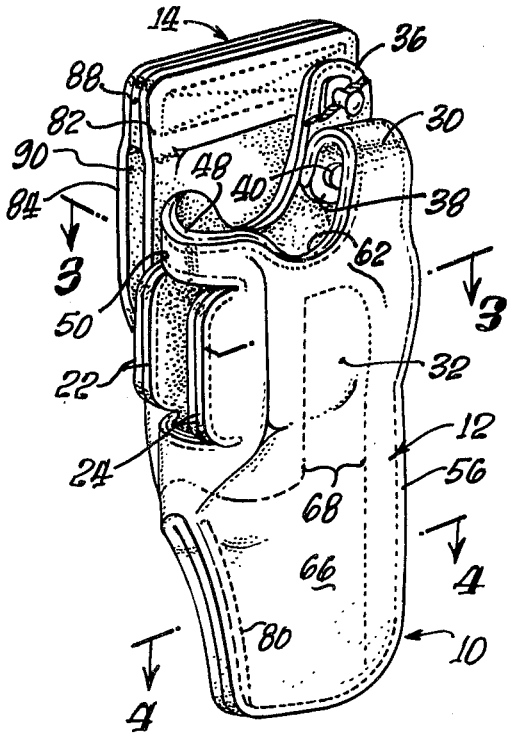
FIG. 1 is a perspective side view of a holster constructed according to the present invention.
Figure 2:
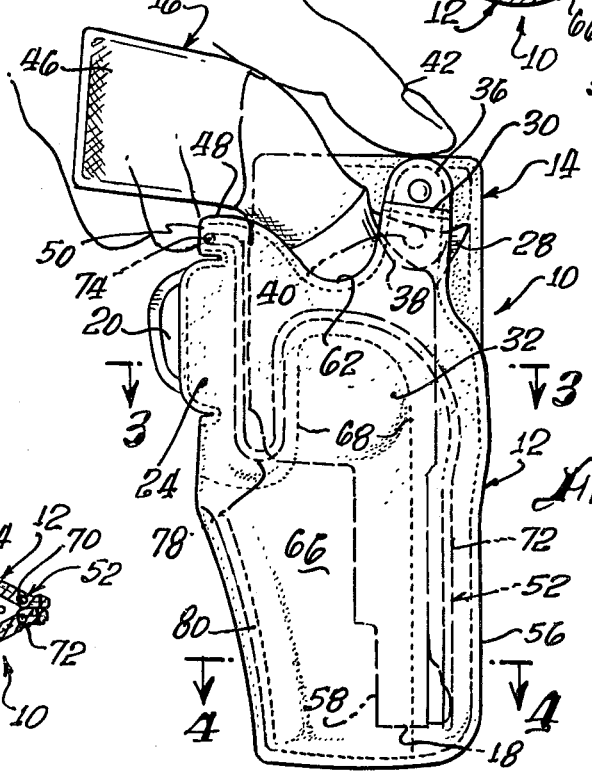
FIG. 2 is a side view of the holster of FIG. 1 with a weapon therein about to be removed by the user.

Referring to the drawings more particularly by reference numbers, number 10 in FIG. 1 refers to a holster constructed according to the present invention. The holster 10 includes a sheath 12 and a hanger 14. As shown in FIG. 2, when a pistol 16 is within the holster 12, the pistol 16 is retained with its muzzle 18 downwardly. At the same time the trigger 20 is protected by flaps 22 and 24 which extend rearwardly along the trigger guard 26 of the revolver 16. The flaps 22 and 24 assure the security of the trigger 20 while the pistol 16 is within the sheath 12 yet allow relatively easy construction of the sheath 12 as will be described hereinafter. The hammer 28 of the pistol 16 is prevented from cocking by means of a strap 30 integrally formed with the outer side portions 32 of the sheath 12 while the inner portion 34 thereof extends upwardly to a thumb break 36 such as is included in the Bianchi, Model 2900 high ride holster. The end 38 of the strap 30 is retained by a snap 40 which is easily disconnected only by thumb pressure on the thumb break 36, the user's thumb 42 being shown in preopening position in FIG. 2.

When it is desired to remove the pistol 16 from the sheath 12, the hand 44 is placed in its usual position on the handle 46 of the pistol 16, and the thumb break 36 is released. At this time the pistol 16 can be rotated (counterclockwise as shown in FIG. 2) about a pivot 48 formed by an upper loop 50 connecting the inner and outer side portions 30 and 32.

Figure 3:
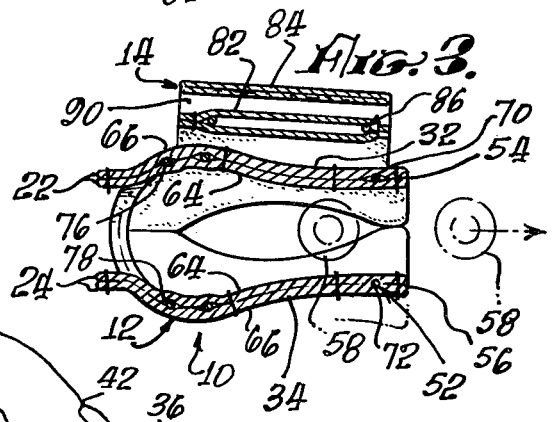
FIG. 3 is a cross-sectional view taken on line 3—3 of FIG. 2.
Figure 4:
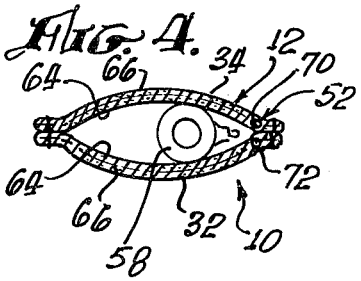
FIG. 4 is a cross-sectional view of the holster taken on line 4—4 of FIG. 2.

The pistol is restrained slightly from rotating by a spring member 52 which extends along the front portions 54 and 56 of the outer and inner side portions 32 and 34 and crosses therebetween at the upper loop 50, as shown in FIG. 4. As shown in FIG. 3, as the barrel 58 rotates upwardly, it spreads the sheath 12 to the configuration indicated in phantom outline in FIG. 3, thus enabling the pistol 16 to be rotated to the firing position shown in FIG. 6.

Figure 5:
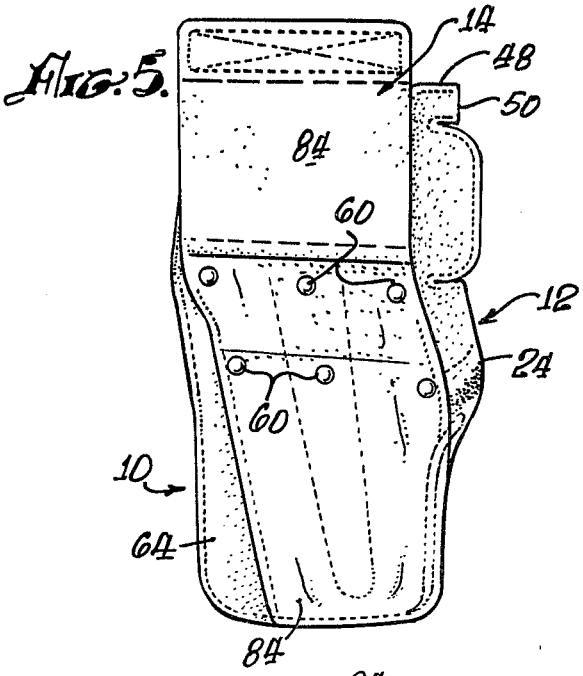
FIG. 5 is an elevational view of the side opposite from that of FIG. 2.

The sheath 12 is retained in position by suitable connections to the hanger 14 which are shown as rivets 60 in FIG. 5. The hanger 14 forms the attachment means to the user's body.

Figure 6:
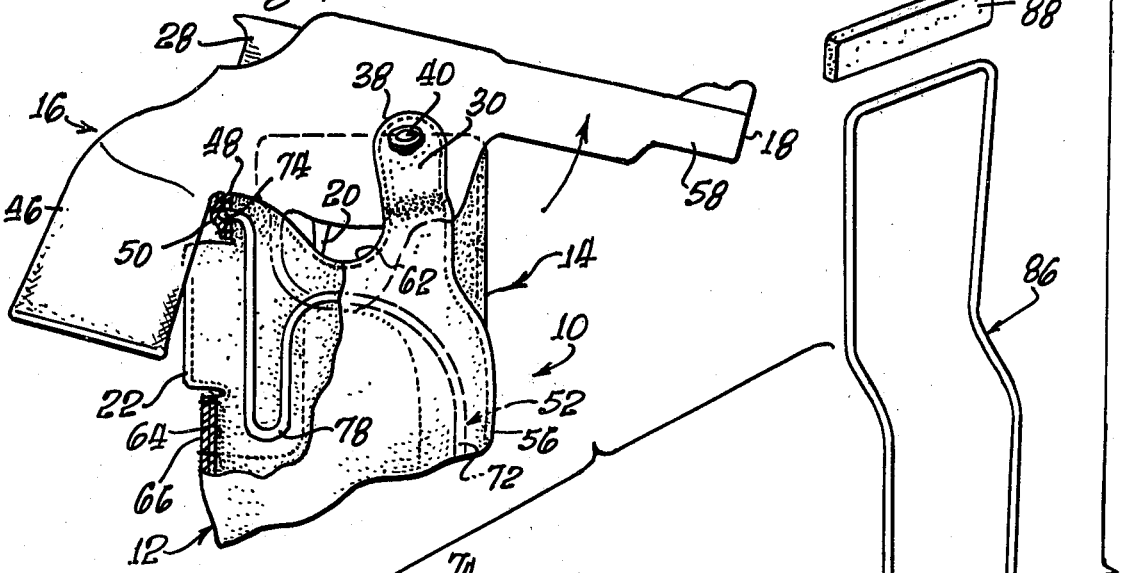
FIG. 6 is a partial side elevational view similar to FIG. 2 with the weapon pivoted and clearing the holster.

As shown in FIG. 6, as the pistol 16 approaches a proper firing position, the cutout 62 adjacent the strap 30 allows finger access to the trigger 20 so that the pistol 16 can be fired practically before it clears the holster 10.

Figure 7:
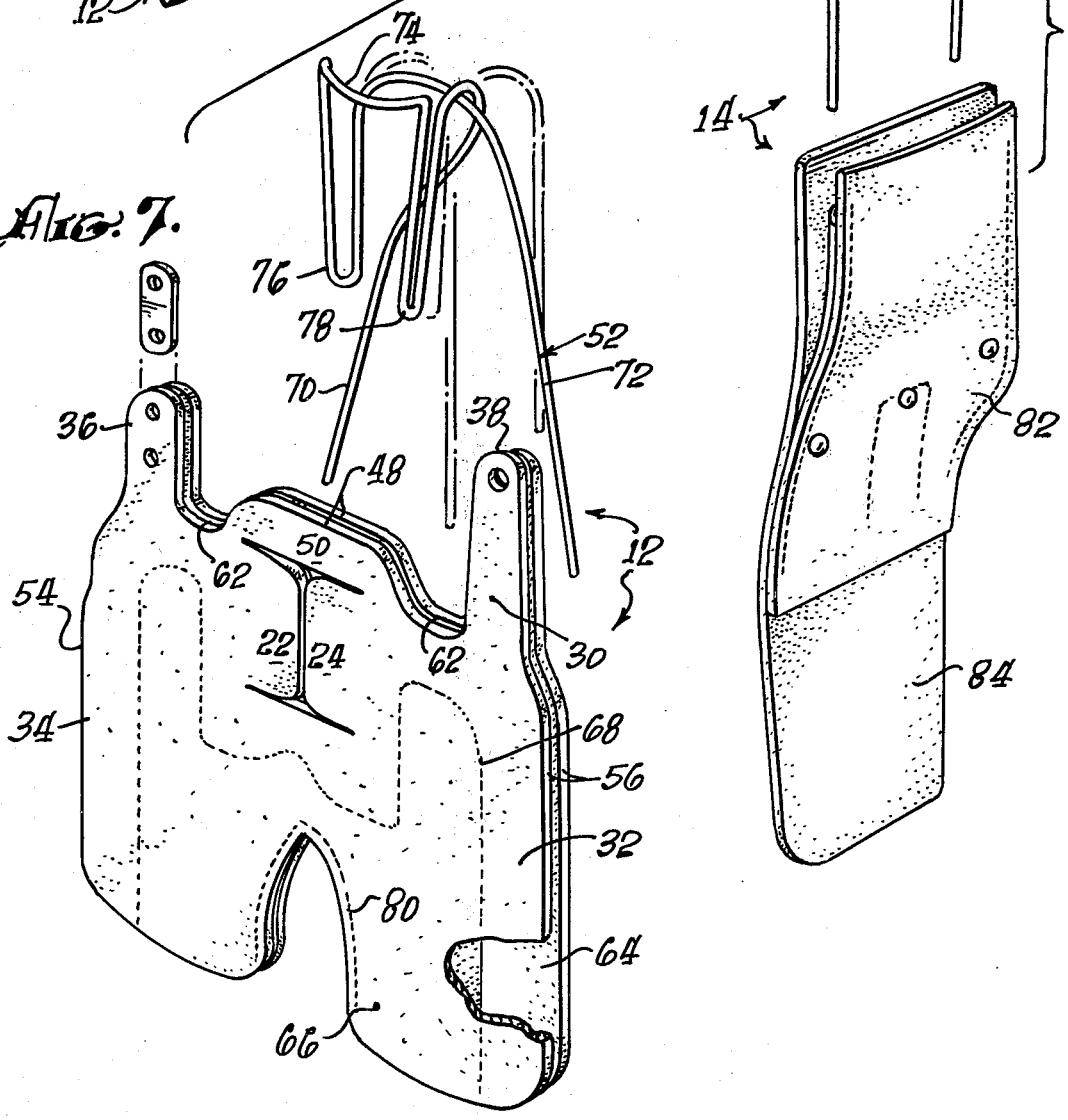
FIG. 7 is an exploded perspective view showing the construction details of the holster.

The construction of the holster 10 can be more clearly seen by reference to FIG. 7. As shown, the sheath 12 is constructed from inner and outer layers 64 and 66 of suitable material such as leather. It is usual that the outer layer 66 be of leather having surface qualities particularly suited to exposure whereas silicon suede lining or the like can be employed as the inner layer 64 suitably shaped for the particular pistol to be used therein with the trigger guarding flaps 22 and 24 cutout as shown. The inner and outer layers 64 and 66 are sewn together about the edges thereof and along the pattern shown by the dashed line 68. The spring member 52 shown in its natural condition in solid outline and in inserted condition in broken line, is inserted between the layers 64 and 66 in the position shown in FIGS. 2 and 6. It should be noted that the spring member 52 in addition to its two downwardly extending leg portions 70 and 72 which act to hold the front edge sections 54 and 56 together, includes a pivot portion 74 centrally therealong and two U-shaped portions 76 and 78 which extend downwardly adjacent the flaps 22 and 24 to stiffen the sheath 12 adjacent the trigger guard 27. The sheath 12 is then stitched together along the dashed lines 80 to enclose the rearward portion thereof.

The hanger 14 is also constructed from two or more layers 82 and 84 which are suitably stitched to enclose a spring stiffening member 86 which is suitably bent to assure clearance between the sheath 12 and the hanger 14. A suitable spacer 88 is provided adjacent the upper edge 84 thereof so that a belt loop 90 (FIG. 1) is formed for retention of the holster 10 to the user.

Thus, there has been shown and described a novel front opening holster which fulfills all of the objects and advantages sought therefor. Many changes, modifications, variations, other uses and applications of the subject invention will, however, become apparent to those skilled in the art after considering this specification. All such changes, modifications, variations, and other uses and applications which do not depart from the spirit and scope of the invention are deemed to be covered by the invention which is limited only by the claims which follow.

The inventor claims:

1. A front opening holster for a handgun having a handle, a muzzle and a trigger guard, including:

means for connection with the user, an outer portion for retaining the handgun, an inner portion for retaining the handgun connected with said means for connection to the user, a loop connecting said inner portion to said outer portion at their upper rear locations, said loop forming a pivot for the handgun to engage the handgun between the handle thereof and the trigger guard thereof, and a spring member shaped and stressed to extend along front edge sections of said outer and inner portions of the holster and to lightly bias said outer and inner portions together to permit spread of said front edge sections by the handgun under light outward rotative force, said spring member including an arcuate pivot portion extending through said loop to stiffen the pivot thereby formed whereby said pivot forms a firm fulcrum for rotation of the handgun thereabout so that the handgun may be removed from said holster by rotating the handle downwardly about said fulcrum to force the muzzle end out of the holster.

2. A holster according to claim 1 wherein:

said outer portion includes a guard flap extending rearwardly along the trigger guard of a handgun positioned within the holster, said flap being positioned below said loop and at least a portion thereof extending rearwardly thereof.

3. A holster according to claim 2 wherein:

said spring member is a unitary spring member and includes a U-shaped portion adjacent to said flap to stiffen said holster in that location.

4. A holster according to claim 3, wherein:

said inner and outer portions thereof are formed from a continuous layer of material, said guard flap being formed by cutting said continuous layer to form a cutout adjacent said guard flap so that the trigger guard of the handgun is extendable rearwardly therethrough when a handgun is in the holster.

5. A holster according to claim 4, wherein:

said inner portion includes an inner guard flap extending rearwardly along the trigger guard of a handgun retained therein opposite said flap which extends rearwardly from said outer portion, said latter flap being formed by cutting said continuous layer.

6. A holster according to claim 3, wherein:

said outer portion includes an upper portion defining a cutout positioned forward of the loop so that upon handgun rotation about the pivot during removal, said cutout uncovers the trigger of the handgun as it rotates into orientation for use.

7. A holster according to claim 1, wherein:

both said outer and inner holster portions have trigger guard flaps extending rearward along the trigger guard of a handgun in the holster, and the spring member has U-shaped portions extending downwardly intermediate said loop portion and each of the respective leg portions to stiffen the holster adjacent the guard flaps.

8. A holster according to claim 7, wherein:

said outer portion includes an upper portion defining a cutout positioned forward of the loop so that upon handgun rotation about the pivot during removal, said cutout uncovers the trigger of the handgun as it rotates into orientation for use.

9. A holster according to claim 6, wherein:

both said outer and inner holster portions have trigger guard flaps extending rearward along the trigger guard of a handgun in the holster, and the spring member has U-shaped portions extending downwardly intermediate said loop portion and each of the respective leg portions to stiffen the holster adjacent the guard flaps.

10. A holster according to claim 9, wherein:

said outer portion includes an upper portion defining a cutout positioned forward of the loop so that upon handgun rotation about the pivot during removal, said cutout uncovers the trigger of the handgun as it rotates into orientation for use.

11. A holster according to claim 2, wherein:

said outer portion includes an upper portion defining a cutout positioned forward of the loop so that upon handgun rotation about the pivot during removal, said cutout uncovers the trigger of the handgun as it rotates into orientation for use.

12. A holster according to claim 1 wherein:

said outer portion includes an upper portion defining a cutout positioned forward of the loop so that upon handgun rotation about the pivot during removal, said cutout uncovers the trigger of the handgun as it rotates into orientation for use.

* * * * *